United States Patent [19]

Malbrunot

[11] 4,300,837

[45] Nov. 17, 1981

[54] DEVICE FOR THE PREPARATION OF COATED BITUMINOUS PRODUCTS FOR ROAD SURFACING

[75] Inventor: Pierre Malbrunot, Saint-Cloud, France

[73] Assignee: Creusot-Loire, Paris, France

[21] Appl. No.: 127,970

[22] Filed: Mar. 7, 1980

[51] Int. Cl.[3] ..... B28C 5/46; B28C 5/20

[52] U.S. Cl. ..... 366/25; 34/135; 366/147; 366/227; 366/229; 432/118

[58] Field of Search ..... 366/25, 24, 23, 22, 366/144, 147, 149, 57, 58, 59, 227, 228, 4, 229; 432/118; 34/135, 136, 137

[56] References Cited

U.S. PATENT DOCUMENTS

| | | | |
|---|---|---|---|
| 2,815,940 | 12/1957 | Madsen | 366/25 |
| 4,071,962 | 2/1978 | Saeman | 432/118 |
| 4,095,284 | 6/1978 | Mendenhall | 366/25 |
| 4,130,364 | 12/1978 | Brown | 366/25 |
| 4,255,058 | 3/1981 | Peleschka | 366/25 |

*Primary Examiner*—Robert W. Jenkins
*Attorney, Agent, or Firm*—Haseltine and Lake

[57] ABSTRACT

The device includes in a rotary cylindrical drum (1) a zone for transfer and heating (11) where the inner surface of the drum (1) is fitted with sections of blades (17) wound in a spiral across the drum (1). These blades (17) arranged projecting with respect to the inner surface of the drum (1), by their edges remote from the drum support baffleplates (18) in a longitudinal direction. The drum (1) likewise exhibits an isolation and drying zone (12) where the inner surface of the drum (1) is fitted with lifter devices (20-21) having a high retention capacity for lifting materials (25) up to the upper portion of the drum (1) and the formation by falling back of these materials (25) of a continuous screen isolating the flame (5) of the burner (4) from the next zone of the drum (1).

5 Claims, 4 Drawing Figures

1
2
3
4
5
6
10
11
12
13
14
16
17
18
20
21
26
27
28
29
II
II'
III
III'
IV
IV'

26

20
21
25

17
18
19

DEVICE FOR THE PREPARATION OF COATED BITUMINOUS PRODUCTS FOR ROAD SURFACING

FIELD OF THE INVENTION

The invention refers to a device for the preparation of coated bituminous products for road surfacing, starting from liquid bituminous binders and granular products consisting of recycled coated matter coming from worn road surfacing and of new aggregate, where the proportion of recycled coated matter with respect to the amount of new aggregate may run from 0 to 100%.

PRIOR ART

At the time of repairing or maintenance of roadways having asphalt surfacing one may be induced to remove the worn surfacing in order to lay new surfacing on the roadway. The aim of this operation is to avoid raising the level of the roadway at each repair of the surfacing by superimposing successive layers of surfacing.

The worn surfacing may be removed by milling or if it has been removed in slabs, subjected to crushing: granules are thus obtained, which consist of aggregate of small dimensions such as pebbles coated and agglomerated together by the asphalt binder. The products resulting from these removals of roadway are in general got rid of, but it has appeared desirable to reuse them in coating stations, because this operation has the advantage of economizing new products, whether aggregate or bituminous binders, and of solving the problem of getting rid of the waste matter coming from the operations of removal.

Hence coating installations have been devised which enable this waste matter to be treated by recycling it.

The most effective coating installations which are usually employed now, include a cylindrical drum of large dimensions within which are carried out at one and the same time the drying of the granular material to be coated, the mixing of these granular products with the liquid bituminous binder and the coating of the granular materials by the bitumen in a hot atmosphere. Hence the materials are brought into contact with very hot gases or with a flame during at least part of their path through the cylindrical dryer-coater drum.

The materials are in short dried and heated inside the drum by the flame from a burner entering through one of the faces of the drum and directed axially into this drum, generally through the face of entry of the products to be coated.

The drum is mounted to be able to rotate about its longitudinal axis and sloped slightly so as to ensure the flow of the products which are raised inside the drum by blades arranged on the inner surface of this drum so as to ensure contact between the hot gases and the solid matter flowing through the drum.

Conventionally the materials are in general introduced into the drum through the input face wet and cold and are heated and dried at least partially in the first zones of the drum before being mixed with the liquid bituminous binder and coated in a hot atmosphere in the last zones of the drum.

In particular such an installation is known, which forms the object of a French Pat. No. 2,327,048 filed by the Applicant, where the zone of drying and prior heating of the granular materials before mixing with the liquid bituminous binder, where the flame of the burner is developed, is isolated completely by a continuous curtain of materials raised in the drum by lifting devices, from the next zone where the introduction of the bitumen takes place. In this way putting of the flame of the burner in contact with the bitumen is avoided and thus its destruction by combustion is avoided.

In the case of recycled material containing a high proportion of asphalt matter and aggregate, such an installation cannot be employed because the granular products introduced at the input to the drum would be put into contact with the burner flame along the whole zone of drying and heating prior to mixing. In this zone the asphalt material would be altered by combustion upon its coming into contact with the burner flame and rendered unfit for use on roads.

On the other hand it is in practice indispensable to conceive of installations which enable treatment both of material including a more or less large proportion of recycled materials and of solely new materials. In short the recycled material are not in general available in sufficient quantity for feeding the coating installation for long periods of operation and it is very often necessary to feed the coating installation with a mixture of new materials and recycled materials or even with solely new materials.

Hence installations have been devised which are capable of treating both new materials and mixtures of new materials and recycled materials.

A coating installation is, for example, known which includes a conventional dryer-mixer drum at the input end of which a combustion chamber of refractory steel has been fitted so as to introduce the mixture of granular products which may include a certain proportion of recycled products, after the burner flame in order to avoid destruction by combustion of the bitumen contain in the recycled materials. In short, the flame and the gases at very high temperature are thus produced in a chamber distinct from the drum into the interior of which are introduced the granular materials and in which these materials are raised across the whole area of the drum for putting them in contact with the hot gases coming from the combustion chamber, with the result that the direct contact of the flame with the granular materials including bitumen is avoided and the employment of recycled products is made possible, whilst avoiding their combustion with its generation of smoke. In an installation of this type it is equally possible to treat granular products consisting solely of new materials.

But such installations present disadvantages since the length of installation is increased by the presence of a combustion chamber, considerable thermal losses exist which are caused by the high temperature of the combustion chamber and there is a risk to the personnel who are caused to work close to a chamber the outer temperature of which is extremely high. The thermal losses of such an installation may be of the order 5 to 10% of the energy of combustion. An installation is likewise known which includes a double drum consisting of an inner drum of small diameter and an outer drum of large diameter mounted coaxially and so that the small-diameter drum projects with respect to the large-diameter drum over a certain length corresponding with the zone of input of the new products which are introduced into the inner small drum into the interior of which penetrates the flame of the burner. The recycled materials are introduced into the large-diameter outer drum and traverse the length of this outer drum until the time when they are mixed with the new materials at the outlet from the inner small-diameter drum where it opens into the interior of the outer drum.

During their progress along the outer drum the recycled materials are isolated from the flame by the small-diameter inner drum where the heating and drying of the new materials takes place by contact with the very hot gases and with the flame. The mixing with the bitumen and the coating are effected in the large-diameter drum after the zone of this drum where the outlet end of the inner small-diameter drum opens out.

This device presents certain disadvantages since the production capacity is small, as the small drum does not allow of a free volume sufficient for enabling the development of thermal power sufficient for a drum of the diameter of the outer drum, and since the separation between new material and recycled material at the time of their introduction into the installation necessitates two feed devices with continuous weighing of materials. On the other hand the length of the installation is considerably greater than the length of a conventional installation and the flexibility of use of this installation is not very great because in these installations coated matter cannot be manufactured solely from recycled material or solely from new material under satisfactory conditions.

In short, if solely recycled coated matter is employed the small drum would be destroyed by the flame because it would no longer be protected during operation by the new materials in contact with its inner wall. On the other hand if one tries to manufacture coated matter solely from new material the production capacity of the installation is reduced to that of a dry-mixer drum the diameter of which would be that of the small drum, that is to say, to a considerably lower level since the production varies as the square of the diameter of the drum.

The idea has likewise been considered of cutting apertures in the wall of a conventional dryer-mixer drum and fitting to it a device for the introduction of recycled materials in order to introduce these materials into a zone lying after the burner flame.

This device presents, however, the disadvantage of necessitating two different feed devices with continuous weighing, one at the input to the drum for the new material and the other after the flame at the level of the apertures provided in the drum for the introduction of the recycled materials.

On the other hand such a device cannot operate solely with recycled materials because the flame of the burner would destroy the drum in the input zone, with the new materials no longer protecting the inner surface in this zone.

SUMMARY OF THE INVENTION

Hence the aim of the invention is to propose a device for the preparation of coated bituminous products for road surfaces, starting from liquid bituminous binders and granular products consisting of recycled coated matter coming from worn road surfacing and or new aggregate, where the proportion of recycled coated matter with respect to the proportion of new aggregate may run from 0 to 100%, consisting of a drum of cylindrical form mounted to be able to rotate about its longitudinal axis on a platform and including means of driving it in rotation and means of feeding it with granular products at one of the ends of the drum, called the input end, a zone for introduction of the products brought by the feed means, following the input end, in which the drum includes spiral blades for rapid introduction of the products into the drum, a burner entering axially into the drum through the input end, a zone for mixing in a hot atmosphere, in which the drum includes lifter devices of high retention capacity for the raising of the products and their falling back across the whole cross-section of the drum, and at the entry to which is situated the discharging end of a feeding device for bringing in liquid bituminous binder, and a fixed chamber for discharge of the coated products and for exhaust of the gases flowing in the drum in communication with the output end of the drum, the drum sloping from its input end down to its output end in order to ensure flow of the products, this device necessitating no means of supplementary introduction for the recycled products and including no supplementary combustion chambers at the inlet to the drum.

With this object the drum includes between the introduction zone and the mixing zone in succession in the direction of flow of the products:

a zone for transfer and heating of the granular material where the inner surface of the drum is fitted with sections of blades arranged in a spiral over the inner surface of the drum, projecting with respect to this surface and supporting by their edges remote from the surface of the drum baffleplates arranged along the direction longitudinal to the drum, the blades playing the part of distance-pieces and of a guide for the granular material flowing between the inner surface of the drum and the baffleplates;

and an isolation and drying zone where the inner surface of the drum is fitted with lifter devices having a high retention capacity for lifting the granular material up to the high portion of the drum and the formation by falling back of the materials of a continuous screen isolating the flame from the next zone of the drum. In order to let the invention be clearly understood, by way of non-restrictive example an embodiment will now be described by referring to the Figures enclosed, of a device for the preparation of coated products which enables the employment of new materials and of recycled materials in any proportion.

DETAILED DESCRIPTION

Figure 1:
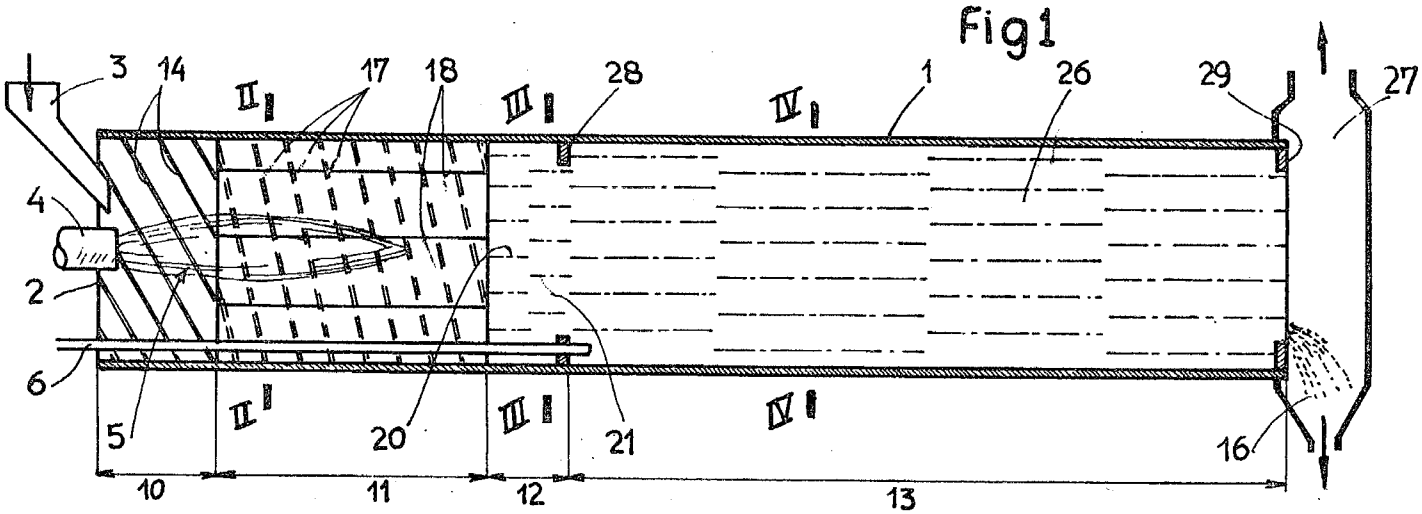
FIG. 1 represents a longitudinal section of a dryer-coater drum in accordance with the invention.

In FIG. 1 is seen a drum 1 consisting of a cylindrical envelope of steel mounted to be able to rotate about its longitudinal axis upon a platform which is not shown.

Devices for support and for setting it in rotation, likewise not shown, enable this cylindrical envelope to be made to revolve continuously about its longitudinal axis during the operation of the installation.

The drum includes an input end surface 2 through which enters a device 3 for feeding granular products, which enables there to be brought continuously into the drum the granular products consisting both of new materials and of recycled materials.

A burner 4 likewise enters through the input end surface 2, the flame 5 from which is developed in the first zones of the drum.

The drum likewise includes a device 6 for feeding with liquid bituminous binder, which enables this bituminous binder to be introduced inside the drum and to be spread in a divided form over the granular materials.

The drum has an introduction zone 10 which receives the solid granular products brought by the feed device 3 and makes them arrive very rapidly without contact with the flame 5 from the burner, in the zone 11 of the drum.

For doing that, the inner surface of the drum in the zone 10 is fitted with blades wound in a spiral 14 which as a function of the rotation of the drum enables extremely rapid introduction of the products which have a practically negligible time of dwell in the zone 10 and which remain during this short lapse of time held against the wall of the drum by the blades 14.

The next zone 11 of the drum is a zone for transfer and heating of the granular materials coming from the zone 10, inside which is developed the flame 5 from the burner 4.

In this zone 11 the drum is fitted with blades arranged projecting above the inner surface of the drum, along sections of spirals of short pitch. Onto the ends of the blades 17 remote from the inner surface of the drum are fixed baffleplates 18 following the direction longitudinal to the drum.

The inner surface of the drum in the zone 11 is fitted with a number of sets of blades onto which are fixed baffleplates 18 so that a considerable portion of the inner surface of the drum in the zone 11 is protected by these baffleplates.

Figure 2:
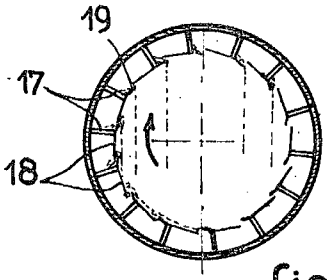
FIG. 2 represents a section along II—II in FIG. 1.

In FIG. 2 may be seen the cross-section of these baffleplates 18 through a plane perpendicular to the axis of the drum. These plates are practically plane and exhibit each a straight edge and an edge 19 folded across a narrow width. This folded edge 19 enables slight overlapping of the plates to be achieved so that the folded edge 19 of one plate slightly overlaps the straight edge of the adjacent plate. This enables the whole surface of the drum to be covered over whilst leaving a possibility of expansion of the plates undergoing heating due to the flame from the burner.

When the granular material including a certain proportion of recycled material is introduced into the zone 11 of the drum in contact with the wall of this drum it is guided and carried along by the blades 17 in a motion which makes it progress towards the inside of the drum, and isolated from the flame 5 thanks to the baffleplates 18 which enable direct contact with the flame 5 to be avoided. Only a very small amount of material falls down through the interstices between the plates into the zone of the flame. The granular material in the zone 11 although isolated from direct contact with the flame is during the whole passage through this zone in contact with gases at very high temperature passing through the interstices between the plates and with the hot metal surface of the plates 18, which causes drying and heating of it enabling melting of the bitumen from the recycled materials whilst avoiding the destruction of this bitumen.

On the other hand the material kept in contact with the inner surface of the drum behind the baffleplates enables the thermal losses to be limited through the surface of the drum and thus the efficiency of the installation to be improved. On the other hand falling of the material into the flame and direct contact between the flame and the recycled material are avoided thanks to the baffleplates. Finally the layer of material retained between the baffleplates and the wall of the drum enables this wall to be protected against the flame.

The height of the blades arranged along sections of spirals is sufficient for enabling flow of the products against the wall of the drum.

The length of this zone 11 is chosen so that the flame is developed in it normally.

Figure 3:
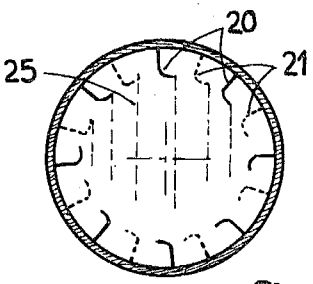
FIG. 3 represents a section along III—III of FIG. 1.

The zone 12 of the drum which is an isolation zone for heating and drying of the materials, arranged in continuation of the zone 11, is formed by a portion of the drum where the inner surface of this drum is fitted with lifter devices the cross-section of which may be seen in FIG. 3. Two sets of identical lifter devices have been arranged along the length of the drum, the first set including lifter devices 20 and the second set lifter devides 21, offset angularly over the surface of the drum with respect to the blades 20 and arranged in continuation of the blades 20 along the length of the drum.

It may be seen from FIG. 3 that these lifter devices enable collection of the solid granular materials at the low portion of the drum and lifting of these materials upto the highest portion of the drum where the granular materials 25 fall back in free across the whole area of the drum during the rotation of this drum.

A screen is thus formed across the whole area of the drum, this screen enabling the flame 5 to be isolated completely from the zone 13 of the drum lying beyond the zone 12 which forms an isolation zone.

On the other hand in the zone 12 the material previously heated by contact with the hot gases in the zone 11 and traversed at the time of its falling back like rain in the drum by the hot gases moving from the flame towards the outlet from the drum undergoes an intense drying which enables it to lose practically the whole of its humidity before its introduction into the zone 13. This application of heat by the gases likewise enables the melting of the bitumen from the recycled material to be completed.

The lifter devices 20 and 21, contrary to the blades 14 and 17, do not produce a rapid advance of the product inside the drum with the result that the zone 12 is a zone where the product is slowed down and occupies the whole area of the drum for a relatively long time in spite of the short length of the zone 12.

On the other hand the gases passing through the dense curtain of materials, formed in the zone 12, and causing the heating and drying of these materials, undergo a considerable lowering of temperature with the result that the gases enter the zone 13 at a temperature much lower than the temperature prevailing the zone 11.

On the other hand the stirring of the materials at the time of their lifting and falling back across the area of the drum causes a mixing and homogenization of the different solid materials constituting the charge introduced into the drum, whether it is a question of new aggregate, of powery matter or of recycled material. Thus these materials introduced simultaneously but not forming a homogeneous mixture at the input into the drum are mixed in the zone 12 effectively. The zone 12 is a zone of short length (10 to 15% of the length of the tube) with the result that in spite of the intensive drying of the materials in this zone, taking flight of the constituents in large amounts into the gases flowing through the drum is avoided, which avoids the throwing out of a large amount of dust in the gases at the outlet from the drum. At the outlet from zone 12 the materials are introduced into the next zone practically dry and heated, with the result that the spreading of the binder over these granular materials at the start of the zone 13 is greatly facilitated. The tubing 6 for spraying binder opens out in fact approximately at the entrance to zone 13, that is to say, at a place protected from the flame thanks to the screen formed in the zone 12, and where the gases are flowing in the drum at a moderate temperature.

In this way the binder cannot be destroyed by the radiation from the flame and by the gases at too high a temperature.

In the zone 13 which is a zone for mixing the solid granular products and the bituminous binder in a hot atmosphere, the inner surface of the drum is fitted with lifter devices 26 which enable the granular materials to be raised up to the high portion of the drum and let fall back across the whole area of this drum in order to ensure good contact between these materials falling like rain and the gas passing through the zone 13 of the drum in order to ensure hot coating of the materials, that is to say, the spreading and the connection of the surface of the granular materials and the bitumen.

It may be seen that the lifter devices 26 are arranged in four successive sets offset angularly over the surface of the drum, along the length of the zone 13.

At the outlet from the zone 13 which forms the last zone of the drum the coated materials fall into a discharge chamber 16 which on the one hand enables collection of the coated materials and on the other hand thanks to a chimney 27 the collection of the gases upon their leaving the drum.

The zone 13 is bounded by two crowns 28 and 29 the height of which is substantially the same as that of the lifter devices, these crowns serving as a screen and contributing to increasing the thermal efficiency of the drum.

Inside the zone 13 the flowing gases which carry along in the zones where the drying of the granular materials is carried out, a portion of the powdery content of these materials, enter again into contact with coated particles which trap the powdery matter in suspension in the gases and thus extract dust from this gas which leaves through the chimney 27 with a negligible proportion of dust. The quality of coating and the efficacy of the extraction of dust from the gases in the zone 13 are the better, the greater the length of this zone.

In any case the length of this zone is greater than half the length of the drum.

One of the advantages of the device in accordance with the invention is that of being able to employ granular materials consisting both of new material and recycled material in any proportion. In particular one may employ solely new material or solely recycled material or else any proportion of new material with respect to the recycled material without the operation of the device in accordance with the invention being for all that modified.

In the case where only recycled materials are being employed it is possible to avoid the addition of binder, if the binder contained in the recovered materials has a composition in accordance with the final formula desired.

But generally a certain amount of pure liquid binder is added as a function of the amount of recycled material introduced into the drum, the weight of which is measured continuously by the conveyor belt at the input to the introduction device.

Similarly when a mixture of recycled material and new materials is employed it is possible to introduce bituminous binder in supplement or to employ only the bituminous binder from the recycled material.

In any case a weight detector which determines the flow of solid material entering the drum enables continuous calculation, taking into account the water content of the materials, measured by a humidity detector, and if necessary the amount of recycled material introduced with the new material, of the content of topping-up binder necessary for carrying out the coating.

The device in accordance with the invention enables the same drum to be employed for the coating of new materials and for the coating of recycled materials, the production capacity of the installation being the same in any case and the combustion of the bitumen contained in the recycled material being avoided thanks to the employment of baffleplates in the zone where the flame is developed.

The invention is not restricted to the embodiment which has just been described but it includes on the contrary any variants and modifications in points of detail may be conceived of without for all that departing from the scope of the invention.

Thus the baffleplates may have a section through a transverse plane exhibiting an L-shape in order to ensure better retention of the product. It is equally possible to have baffleplates which exhibit a profiled shape other than the L-shape, for example, the shape of an inverted U the arms of which are directed towards the wall of the drum.

Figure 4:
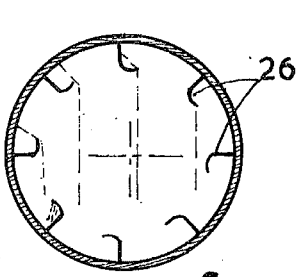
FIG. 4 represents a section according to IV—IV in FIG. 1.

Similarly the shape of the lifter devices in the zones 12 and 13 is not restricted to the shapes which have been represented in FIGS. 3 and 4, but these lifter devices may have an L-shape, a bucket shape as shown or a shape rounded into a more or less closed gutter.

Although it is preferable that the plates occupy the whole of the surface of the drum with a slight overlap of their edges, the baffleplates may equally well occupy only a portion of the surface of the drum according to the extreme conditions of use of this drum.

Finally the device in accordance with the invention may be employed for the production of any bituminous coated matter which can be employed for road surfacing.

I claim:

1. In a device for the preparation of coated bituminous products for road surfacing, starting from liquid bituminous binders and granular products consisting of recycled coated matter coming from worn road surfacing and of new aggregate, where the proportion of recycled coated matter with respect to the proportion of new aggregate may run from 0 to 100%, consisting of a drum of cylindrical form mounted to be able to rotate about its longitudinal axis on a platform and associated with means of driving it in rotation and with means of feeding it with granular products at one of the ends of the drum, called the products input end, and including a zone for introduction of the products brought by the feed means, following the input end, in which the drum includes spiral blades for rapid introduction of the products into the drum, a burner entering axially into the drum through the input end of the drum, a zone for mixing in a hot atmosphere, in which the drum includes lifter devices of high retention capacity for the raising of the products and their falling back across the whole cross-section of the drum, and at the entry to which a device opens out for bringing in liquid bituminous binder, and a fixed chamber for discharge of the coated products and for exhaust of the gases flowing in the drum in communication with the output end of the drum, this drum sloping from its input end down to its output end in order to ensure flow of the products, the improvement which comprises in addition between the introduction zone and the mixing zone in succession in the direction of flow of the products:

a zone for transfer and heating of the granular material, where the inner surface of the drum is fitted with sections of blades in the form of metal bands wound in spirals over the inner surface of the drum, and fixed on said inner surface along one of their two edges, the outer remote from the inner surface of the drum supporting baffle plates arranged along the direction longitudinal to the drum, and an isolation and drying zone where the inner surface of the drum is fitted with lifter devices having a cross-section with concavity sufficient for lifting the granular material up to the upper portion of the drum during the course of its rotation and the formation by falling back of the materials of a continuous screen of material isolating the flame of the burner from the next zone of the drum.

2. The device for the preparation of coated products as in claim 1, wherein the baffleplates are flat sheets one edge of which is folded across a narrow width, arranged so that the folded edge of one sheet slightly overlaps the non-folded edge of the adjacent sheet.

3. The device for the preparation of coated products as in claim 1, wherein the baffleplates have a section through a plane perpendicular to the axis of the drum or a cross-section of L-shape.

4. The device for the preparation of coated products as in claim 1, wherein the baffleplates have a channel cross-section.

5. The device for the preparation of coated products as in any one of claims 1,2,3 and 4, wherein the lifter devices in the isolation and drying zone of the drum are arranged in a number of sets offset angularly in the drum.

* * * * *